United States Patent [19]

Hall

[11] 4,204,741

[45] May 27, 1980

[54] CONNECTOR ASSEMBLY FOR ANODE RING OF CATHODE RAY TUBE

[75] Inventor: Harold E. Hall, Middlefield, Ohio

[73] Assignee: The Stalwart Rubber Company, Bedford, Ohio

[21] Appl. No.: 927,361

[22] Filed: Jul. 24, 1978

Related U.S. Application Data

[63] Continuation-in-part of Ser. No. 788,835, Apr. 19, 1977, abandoned.

[51] Int. Cl.[2] ..... H01R 13/02

[52] U.S. Cl. ..... 339/200 P; 339/258 TC

[58] Field of Search ..... 339/200, 201, 223, 258 TC, 339/275 A, 275 C, 275 T, 60

[56] References Cited

U.S. PATENT DOCUMENTS

| | | | |
|---|---|---|---|
| 2,163,771 | 6/1939 | Alden | 339/258 TC |
| 2,794,176 | 5/1957 | Barnes | 339/275 T |
| 2,882,430 | 4/1959 | Nordby | 339/258 TC |
| 3,258,732 | 6/1966 | Martin | 339/258 TC |
| 3,431,544 | 3/1969 | Valle et al. | 339/201 |
| 3,486,162 | 12/1969 | Leitmann | 339/201 |

FOREIGN PATENT DOCUMENTS

| | | | |
|---|---|---|---|
| 2453565 | 5/1976 | Fed. Rep. of Germany | 339/258 TC |
| 2507546 | 9/1976 | Fed. Rep. of Germany | 339/258 TC |

*Primary Examiner*—Joseph H. McGlynn

*Attorney, Agent, or Firm*—Meyer, Tilberry & Body

[57] ABSTRACT

An improved anode connector assembly for a cathode ray tube gives maximum shielding against x-ray emissions, maximum resistance to high voltage tracking and securely fastens to a standard anode button to prevent accidental removal or displacement. The assembly comprises a one-piece, generally U-shaped clip having surfaces which engage the inner and outer flange surfaces of a standard anode button so as to prevent rocking of the clip when secured within the button. The clip has provision for being securely mounted within a resilient rubber cap of light weight design, which is in pressure engagement with a maximum area of the tube to prevent tracking of the high voltage. A shield washer is mounted in the cap to coact with the clip and restrict x-ray radiation.

14 Claims, 14 Drawing Figures

CONNECTOR ASSEMBLY FOR ANODE RING OF CATHODE RAY TUBE

This application is a continuation-in-part of copending application Ser. No. 788,835 filed Apr. 19, 1977, now abandoned.

This invention relates to the art of electrical connectors, and more particularly to an electrical connector for connecting a high voltage power supply to a standard anode button which is embedded in the envelope of a cathode ray tube.

Cathode ray tubes, such as television display tubes, typically have a conductive button embedded in the side of the envelope for conducting the anode voltage to the inside of the tube. The button is in the shape of an outwardly facing cup having an annular flange extending inwardly around its outer rim creating parallel inner and outer annular surfaces which are in turn parallel to the inner and outer surfaces of the cathode ray tube envelope. This button being necessarily of a material which has a coefficient of expansion the same as the glass unfortunately is not opaque to the transmission of x-rays generated inside the tube. A grounded shield encases the tube except for a small insulating spacing adjacent the button.

Heretofore the connector has been in the form of a rubber dish-like cap. A U-shaped clip had its base embedded into the cap with its legs extending outwardly and with hook portions on the end which engaged under the anode button flange when the cap is flattened against the side of the tube, thus, holding the connector in place due to the resiliency of the cap material.

Problems have existed with such connectors. First, as higher and higher anode voltages were employed, the voltage stresses between the button and the grounded shield caused an ionization of the air gap between the clip and shield resulting in an arc to the grounded shield.

Secondly, with the higher voltages, the amount of x-rays emitted through the button increased.

Thirdly, the connector was not firmly attached to the button so that tension or jerks on the high voltage wire leading to the cap and connected clip and button tended to displace the connector resulting in increased x-ray radiation.

Various means for preventing such x-ray leakage have been proposed such as placing a lead disc or a lead cup in the cupped bottom of the anode button which acts to shield x-ray emissions from the CRT. This type of remedy is shown in U.S. Pat. Nos. 3,600,620 and 3,666,343. Shields of this type are generally loose within the anode button and thus are capable of causing interference with the proper connection of a connector clip to the anode button itself. Such shields are also expensive to manufacture and install.

SUMMARY OF THE INVENTION

The invention relates to an improved form of one-piece metal clip in conjunction with a resilient, flexible rubber cap in a connector assembly which incorporates the improvements of the invention.

For purposes of ease of description, it will be assumed that a cathode ray tube is oriented so that the anode button is on the top surface thereof facing upwardly. Thus, a downward direction will be assumed for the purposes of this description to denote a direction which is inward toward the interior of the cathode ray tube and, conversely, an upward or outward direction will be generally away from the surface and the interior of the tube. When a clip is inserted into the anode button, the legs will thus be extending downwardly and the return bent base portion of the clip will be upwardly or outwardly disposed relative to the anode button. Also, the concave dish-like portion of the anode cap will be facing downwardly toward the surface and the interior of the cathode ray tube, the cap's convex outer surface facing upwardly. It will be understood that these terms are used only for the purposes of facile description and that, in reality, the anode button, clip and connector may be positioned anywhere on the exterior cathode ray tube but that the relationship of these elements relative to each other is always the same.

In accordance with the invention, an anode connector is provided comprised of a combination of a flexible rubber dish-like cap and a generally U-shaped one-piece sheet metal clip having a base embedded in the center of the cap and legs projecting downwardly into the concave underside of the cap. The base of the clip includes a partial cylindrical return bent portion into which the wire to the anode power source extends. The cylindrical return bent portion acts to grip the insulation of the anode supply wire about an arc of at least and preferably greater than 180°. The end of the wire has the insulation removed and the bared end is wrapped around and soldered to an extended lug portion of the clip located at the base adjacent the return bent portion. The wire and clip are tightly fitted into a cavity and passage within the cap which act to prevent rotation of the wire and clip assembly relative to the cap. A tang is also provided on the clip which pierces the insulation of the wire and acts to further prevent rotation of the clip relative to the wire and, thus, relative to the cap.

In accordance with another aspect of the invention, the clip includes a pair of downwardly extending legs terminating in a hook arrangement at the lower end for coacting with the button annular flange and holding the connector in assembled relationship with the tube and means intermediate the length of the legs forming a metallic surface perpendicular to the length of the legs (i.e. parallel to the tube surface and close to the button) opaque to x-rays. In one phase of the invention such means are in the form of a flat horizontal offset portion in each leg, the upper surfaces of such portion also bearing against an opposing downwardly facing surface on the connector for stabilizing the position of the clip relative to the cap. The horizontal offset portions preferably have the maximum offset possible and the offset portions are wider than their legs to give a maximum area for maximum x-ray shielding.

The downwardly extending legs define a plane which is perpendicular to the axis of the cylindrical return bent portion and the axis of the anode wire.

Further in accordance with another aspect of the invention, the leg ends of the clip remote from the base portion have upwardly and downwardly facing surfaces spaced a distance just greater than the thickness of the anode button flange and adapted to engage the downwardly and upwardly facing surfaces of the flange respectively for locking the clip against rocking movement relative to the button.

Further in accordance with another aspect of the invention, a flexible, generally circular rubber-like cap is provided having a head portion with an internal cavity therein for receiving a clip and anode conductor wire. A barrel portion leads radially outwardly from the cavity having a passage therewithin through which the wire may pass into the cavity. The flexible cap also includes a plurality of radially and downwardly extending ribs extending from said head portion and web portions intermediate adjacent pairs of said ribs which ribs and web portions form a downwardly facing concave dish-like skirt on the flexible cap concentric with the head.

Further in accordance with the invention, the above described flexible cap has an approximate center line passing circularly around the mid-portion of the dish-like skirt and the ribs of the skirt are defined only on the concave underside thereof radially inwardly of such mid-line and defined only on the convex outside surface of the skirt radially outwardly of such mid-line.

Further in accordance with the invention, the underside surface of the skirt above-described has a mirror smooth flange surface forming the inside concave surface of the skirt radially outwardly of the mid-line previously described.

Further in accordance with the invention, an anode conductor assembly is provided comprised of a clip portion having a base and parallel extending legs, which base is cylindrically formed and adapted to encircle the insulation of an anode wire about an arc greater than 180°, the cylindrical return bent portion also having an axially extending lug portion and a radially extending tang, which tang pierces the insulation of the anode wire and which lug acts as a point of attachment for the anode wire and a soldered connection therebetween. The legs of the clip include a laterally-offset, transversely-widened portion, parallel extending tapered portions, flange rest portions, and upwardly and downwardly facing surfaces spaced a distance which is at least equal to or only slightly greater than the thickness of a standard anode button flange. In accordance with the invention, this clip and conductor wire assembly is installed within a cavity of a flexible rubber cap comprised of a head portion having the cavity therewithin for receiving the clip and conductor, a barrel portion through which the conductor is admitted to the cavity and an opening in the base of the head portion for allowing the extension of the leg portions of the clip into a conical or dish-like skirt which is formed by a plurality of radially and downwardly extending ribs and webs extending between adjacent pairs of such ribs, the skirt being of a dish-like configuration.

It is a principle object of this invention to provide an anode contact assembly which is inexpensive to manufacture and which retains or improves upon all of the other characteristics of similar anode connector assemblies currently known in the art.

It is another object of this invention to provide a new and improved anode connector including a rubber-like cup and a conductor clip which, when inserted into a standard anode button, prevents rocking of the clip within the button and displacement of the connector relative thereto.

It is a further object of this invention to provide a clip form which positively engages the electrical conductor lead so as to maintain constant its relationship relative thereto and further to retain a constant orientation with respect to a flexible shielding cap disposed thereabout.

It is a still further object of this invention to provide a flexible shielding anode cap containing less rubber like material than that currently used in the art, and which is considerably less expensive, while retaining the resilient strength found in the flexible caps of the prior art.

It is another object of this invention to provide an anode connector clip which will shield x-ray emissions from a standard anode button thereby eliminating the need for auxiliary shielding cups or buttons or heavy rubber caps to attenuate emissions.

It is another object of the invention to provide an anode connector assembly including a clip and flexible shielding cap which clip maintains constant its position relative to the anode button in which it is inserted and further, where the relationship between the clip, anode conductor and flexible cap are maintained stable so that the entire connector assembly including the anode button, clip, flexible cap and conductor are maintained in a substantially constant relationship relative to each other thereby lending substantial stability to the electrical connection.

These and other objects of the invention are accomplished through the design and assembly of anode connectors in accordance with the present invention which will be described in further detail as a preferred embodiment of the invention. Such description of the preferred embodiment should not be construed as in any way limitative of the scope of the present invention.

BRIEF DESCRIPTION OF THE DRAWINGS

The present invention may take physical form in a variety of parts and arrangements of parts, a preferred embodiment which will be described in the specification and illustrated in the apended drawings which form a part hereof and wherein.

DETAILED DESCRIPTION OF THE PREFERRED EMBODIMENT AND DRAWINGS

Figure 1:
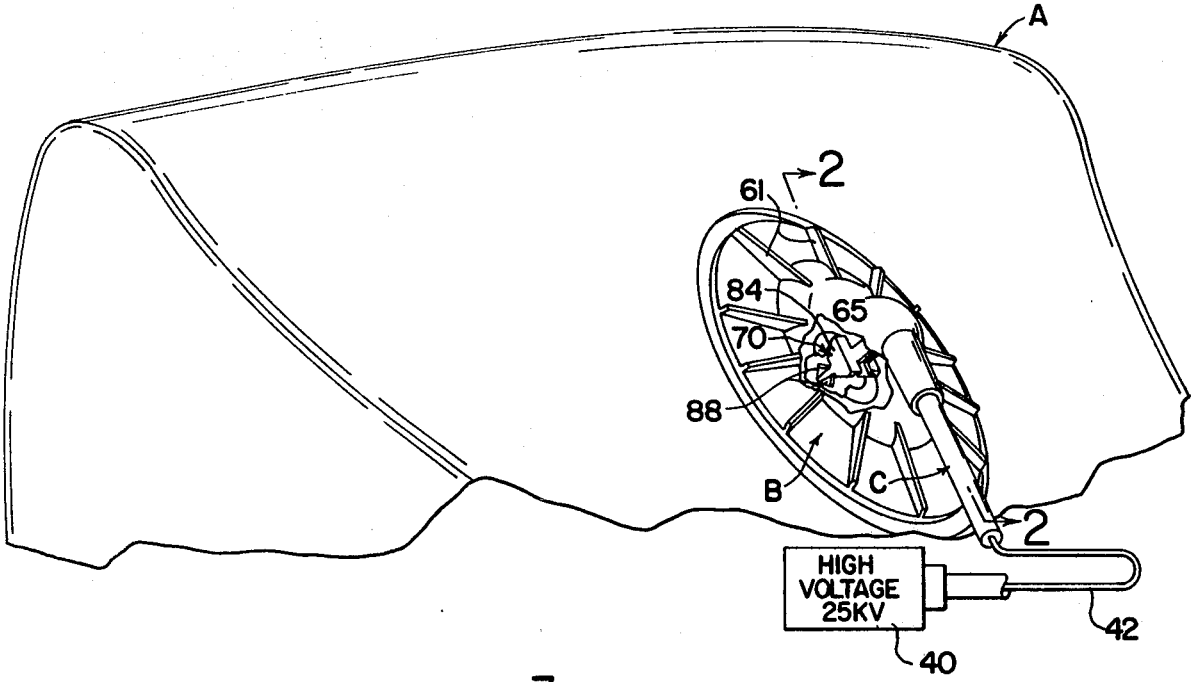
FIG. 1 is a partial perspective view of cathode ray tube showing the preferred connector assembly of the invention operatively associated therewith.
Figure 2:
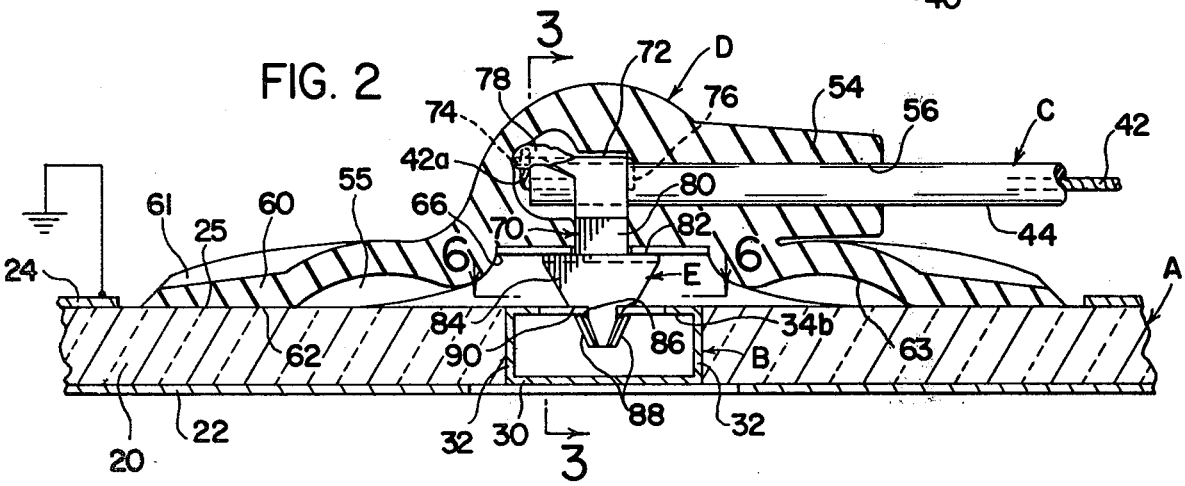
FIG. 2 is a cross-sectional view taken along line 2—2 of FIG. 1.
Figure 3:
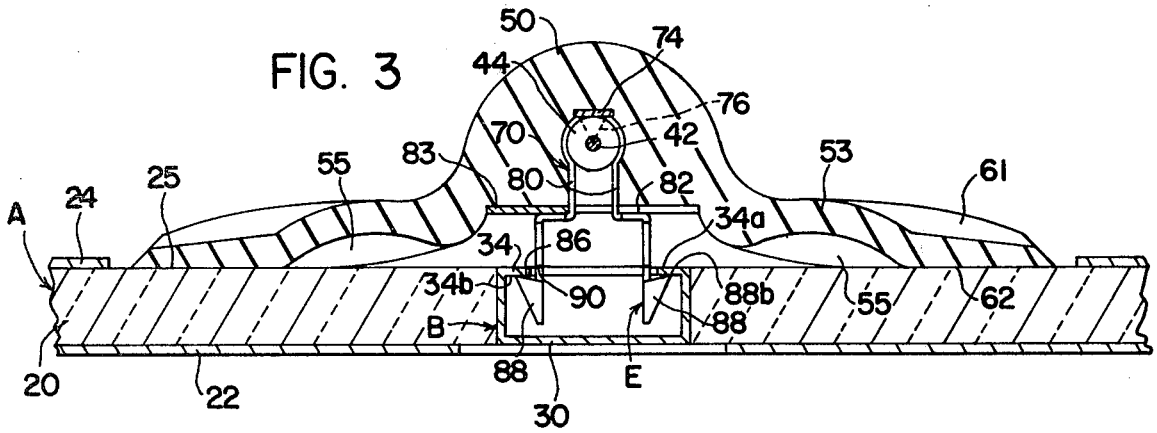
FIG. 3 is a cross-sectional view taken along line 3—3 of FIG. 2.

Referring now to the drawings wherein the showings are for the purpose of illustrating a preferred embodiment of the invention, FIGS. 1, 2, and 3 show a cathode ray tube A having a standard anode button B embedded in its side and the connector itself comprised of a high voltage electrical conductor C, a flexible, shielding anode cap D and a contact clip E therewithin.

Cathode ray tube A is conventional and forms no part of the present invention. Generally it comprises a glass tube envelope 20, a metal inner layer 22 which may be either conductive or shielding, and a metal grounded outer cover 24 which is discontinuous in the area of button B leaving a surface 25 of base glass.

Anode button B is also conventional. It is sealed within the glass envelope 20 and is approximately the thickness thereof and comprises bottom portion 30 which is substantially coextensive with the inner surface of glass envelope 20 and cylindrical side wall 32 which extends from bottom portion 30 outwardly toward the outer surface of glass envelope 20. Side wall 32 may be either cylindrical or conical as it extends outwardly from circular bottom portion 30. An annular flange 34 is integral with the outer circular edge of wall 32, the flange 34 extending radially inwardly in a plane parallel to the outer surface of the glass envelope 20. The flange is defined by a top surface **34*a* which is coplanar with the outer surface of the envelope 20, an underside surface 34*b* parallel to the outer surface 34*a* and circular edge portion 34*c* extending perpendicularly between outer surface 34*a* and underside surface 34*b*. The flange 34 defines a reduced circular opening 36** to the cup-like interior of standard anode button B.

A high voltage supply source 40 is shown schematically in FIG. 1. The output of this source is generally in the range of 25 to 50 kilovolts D. C. Conductor C carries the anode current from the high voltage source 40 to the clip assembly E which is to be inserted in anode button B. Conductor C comprises a flexible metal wire 42 passing through the center of coaxial, cylindrical, flexible insulation material 44.

The end of conductor C remote from the high voltage source 40 passes within flexible cap D and a portion of the insulating sheath 44 is removed so as to provide a bared end **42*a* of the wire 42** within the cap which end is electrically connected to the contact E all as will appear.

Figure 9:
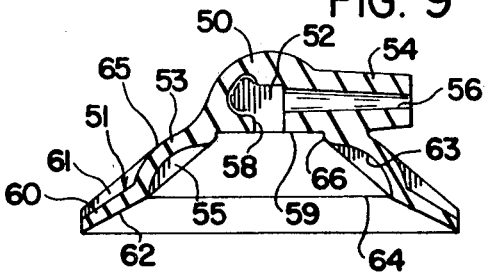
FIG. 9 is a cross-sectional view of the anode cap taken along line 9—9 of FIG. 8.

Flexible cap D, best shown in FIG. 9, has a centrally located head portion 50 having an internal cavity 52 which receives a portion of the connector clip E. Barrel portion 54 having conductor passage 56 therethrough is integral with one side of head portion 50 and conductor passage 56 opens into cavity 52 within the head portion 50. In accordance with the invention, conductor passage 56 is normally of a diameter substantially smaller than the outside diameter of conductor C so that when the conductor C is in the passage 50, the material around the passage is under tension and tightly grips the outside of conductor C. Conductor passage 56 is preferably of a generally tapered form outwardly from cavity 52 to facilitate insertion of conductor. The head 50 has a downwardly facing generally flat surface 59. Opening 58 from cavity 52 through surface 59 is provided so that the clip legs may extend outwardly from cavity 52 when the clip and conductor are mounted within cap D as will appear hereinafter.

A flexible skirt 51 extends outwardly and downwardly from the head 50, the skirt generally being comprised of a first inner portion 3 adjacent to head 50 which portion 53 has a plurality (12 being shown) of equally spaced radially extending downwardly facing ribs 55 and a second outer rim portion 60 having an equal number of spaced upwardly facing radially extending ribs 61. These ribs 61 are generally aligned with the ribs 55 and the adjacent ends thereof overlap but on the inner and outer surfaces. The inner ends of the ribs 61 are smoothly faired into the outer surface of the inner portion 53 as at 65. The downwardly facing surface 62 of the outer rim portion 60 is generally conical and is a smooth, preferably glass-smooth, surface so that when the cap D is placed in position on a television tube, this entire surface will pressure engage the outer surface of the tube and there will be no air pockets between the surface 62 and the tube surface where the air can ionize under extremely high voltages and tracking and failure can start.

The downwardly facing surface 63 of the first portion is generally cupped at a greater angle than that of the conical surface 62 so that the surfaces meet at a line 64. The smooth surface of the cup is broken by the downwardly facing ribs 55. This cup surface 63 terminates at its upper inner edge in a shoulder 66 which defines the circular flat surface 59.

The rib construction with the intermediate webs provides a skirt 51 which has a maximum section modulus for a minimum amount of relatively expensive material forming the skirt.

As will appear and as shown in FIGS. 2 and 3, when the cap is installed, the downwardly facing ribs 55 are tangent with the now flexed surface 60 and the surface of the tube and their surfaces leave the surface of the glass in a smooth tangential curve.

The cap is made from a rubber-like flexible material which may be any natural rubber or synthetic elastomer which will provide the necessary effective resiliency but preferably from silicon rubber material. The electrical insulative and heat resisting properties of silicone rubber are well known. The preferred design of a cap allows the use of a minimum amount of this very expensive and heavy material without a substantial increase in cost or weight of the cap over prior art flexible caps which are constructed of some other type of elastomer. When the above-described mirror smooth surface 62 is in total pressure contact with the glass tube surface surrounding the anode button, a most effective insulating shield is created. Further, the silicone rubber material offers the well known advantages of being resistant to oxidation and ozone degradation, and also being corona shielding.

The configuration of Clip E is an important part of the present invention. Clip E is preferably formed in one piece as a stamping from sheet metal and generally comprises a pair of legs 70 having parallel extending longitudinal axes and a base portion 72 extending between the ends thereof in the form of a substantially cylindrical return bent portion. The return bent portion has its longitudinal axis perpendicular to the axes of legs 70 and plane defined thereby. Return bent portion 72 is a partial cylinder of an inner diameter such that when installed it will tightly grip the insulation 44 of conductor C about an arc at least and preferably greater than 180°.

Return bent portion 72 has an extension at one axial end thereof to form a lug 74 to which the bared end of conductor lead wire **42*a* may be soldered. A pointed tang 76 extends perpendicular to and radially inwardly toward the axis of return bent portion 72 and parallel to the plane passing through the axes of legs 70. The tang preferably has a length which is approximately equal to the thickness of conductor insulation 44. This tang in the embodiment shown is on the opposite axial end of portion 72 from lug 74 although it could be struck from the base of portion 72 by a piercing tool. The tang 76 is adapted to pierce the insulation 44 so as to positively locate the clip relative thereto. The tang is not for the purpose of establishing electrical contact with the wire 42** within conductor C although there would be no detrimental effect should such contact occur.

Figure 4:
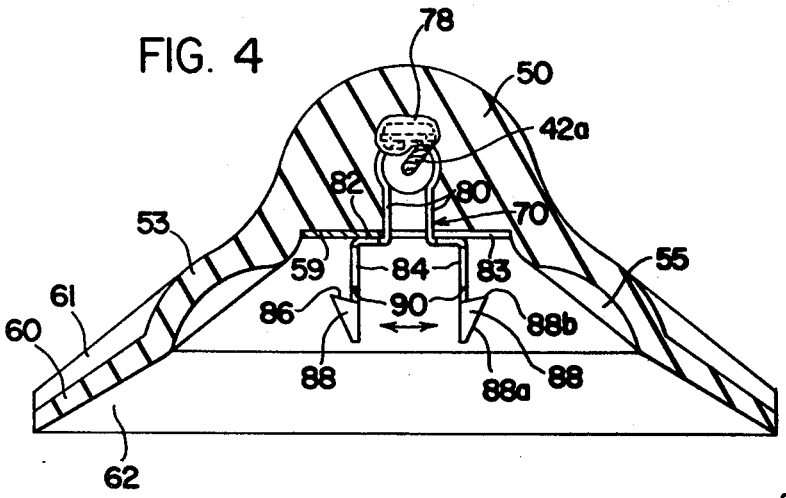
FIG. 4 is a cross-sectional view similar to FIG. 3 but showing the connector assembly disconnected from the anode button.

In the preferred embodiment, conductor C is pressed into the return bent portion 72 between the legs 70 of the clip and tang 76 pierces the unsulation 44 so as to positively lock the conductor C with respect to the clip E both against longitudinal and rotational movement. A portion of insulation 44 is located along the underside of lug 74. Return bent portion 72 surrounds the insulation 44 about a portion of its circumference greater than 180° as can be seen in FIGS. 3 and 4.

Figure 5:
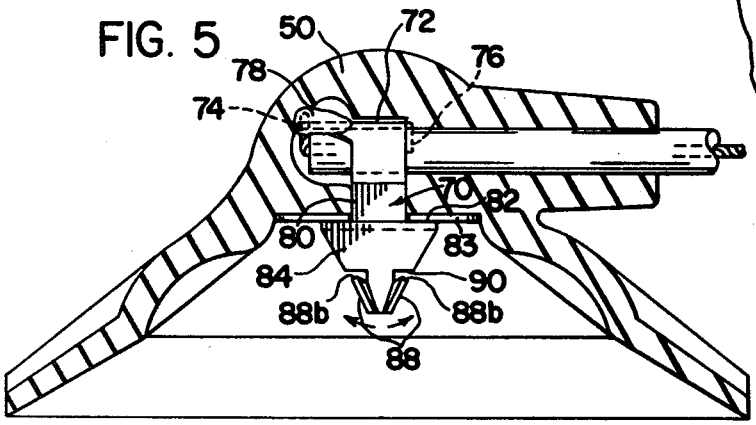
FIG. 5 is a cross-sectional view similar to FIG. 2 but showing the connector assembly disconnected from the anode button.
Figure 7:
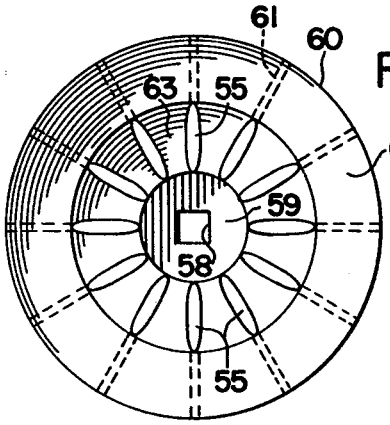
FIG. 7 is a bottom plan view of the flexible cap.
Figure 8:
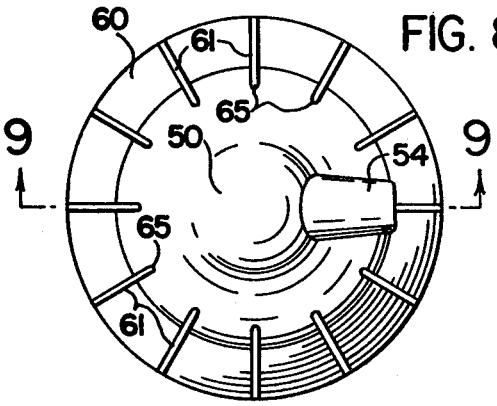
FIG. 8 is a top plan view of the flexible cap shown in FIG. 7.

As best shown in FIGS. 2 and 5, conductor C is inserted in return bent portion 72 between the leg portions of Clip E so that it extends along the underside of lug 74 toward the remote end thereof. Bared conductor wire **42*a* is then wrapped around lug 74 and soldered thereto in such a manner as to create a generally spherical solder bead 78 at the point of connection. By such shape, solder bead 78 forms a smooth rounded bead around lead 42*a* and lug 74** so as to reduce the possibility of corona discharge from any sharp points which might otherwise exist.

Legs 70 include first portions 80 extending from the conductor-encircling return bent portion 72 for a short distance generally equal to the length of opening 58 of cap D as will appear hereinafter, at which point the legs extend laterally outwardly away from each other to form outwardly facing shoulders 82. These shoulders 82 are wider than leg portions 80 transversely, parallel to the axis of return bent portion 72 and form a means of substantial area compared to the button area which is opaque to x-rays.

The upper surface of these shoulders 82 bear against a flat metallic washer 83 of a diameter equal to the diameter of the bottom surface 59 of the cap head 50. To aid in assembly after conductor C has been assembled with the chip E this washer 83 has a deep rectangular slot 87 in its edges of a dimension to pass the width of leg portions 80 and deep enough to receive both leg portions 80. This washer 83 as can be seen from FIGS. 2 and 3 has a diameter in excess of the outer diameter of button B and increase the area of the metallic surfaces which are opaque to any x-rays passing through button B.

From the laterally outward edges of shoulder portions 82, the transversely widened legs 73 are bent perpendicularly away from return bent portion 72 so that they are again parallel to the original leg axes to form mutually parallel portions 84. The edges 85 of these leg portions converge at an angle as shown and each edge is provided with a notch which extends inwardly transverse to the plane of leg portions 84 toward the axis of each leg to form a downwardly facing surface 90 and an upwardly facing surface 86.

The portion of the edges below the notches are bent laterally outwardly away from each other and away from the leg axes to form tabs 88. The tabs 88 have downwardly and inwardly converging edges **88*a* to aid in the insertion of Clip E into the anode button B. The edges 88*a* and surface 86 define a corner 88*b***.

Figure 11:
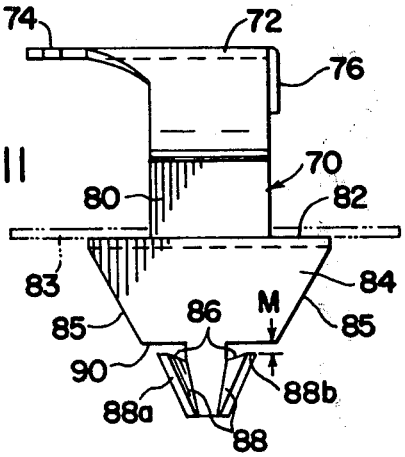
FIGS. 11, 12 and 13 are a side, end and top elevational views of the anode connector clip with the shield washer being shown in phantom.
Figure 12:
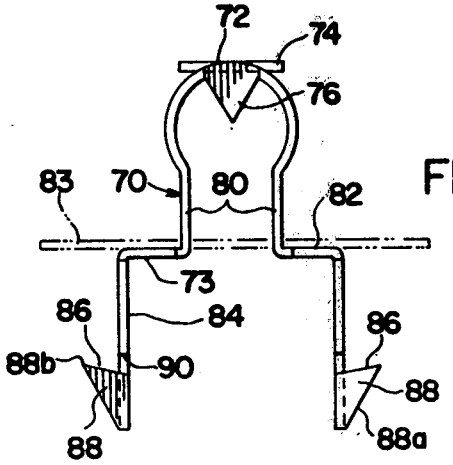
Figure 13:
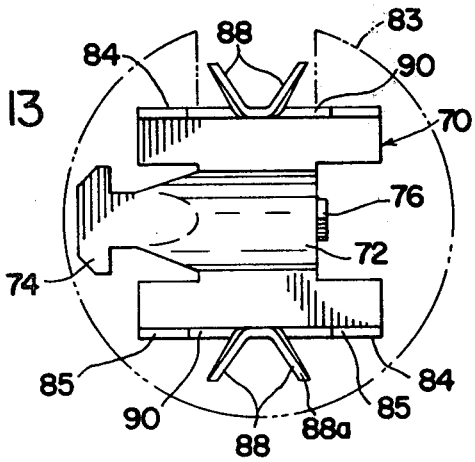
Figure 14:
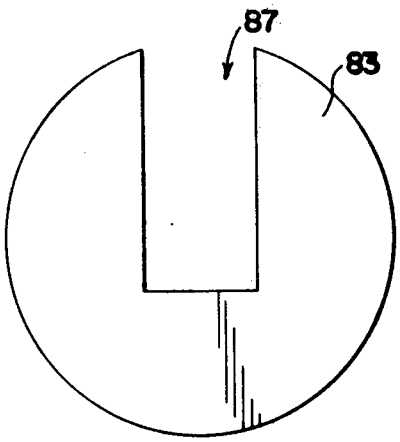
FIG. 14 is a top elevational view of the shield washer.

The downwardly facing surfaces form flange rests 90 which are spaced from the upwardly facing surfaces 86 and tab outer end corners **88*b* a distance M shown in FIG. 11 which is equal to or slightly greater than the thickness between top and underside surfaces 34*a*, 34*b* of anode button flange 34. Thus, when the lower ends of clip legs 70 are compressed together and pass through opening 36 in anode button B and are then released, tab corners 88*b* engage the underside 34*b* of flange 34 in anode button B while flange rests 90 abut or are very slightly spaced from top surface 34*a* of flange 34**.

Figure 6:
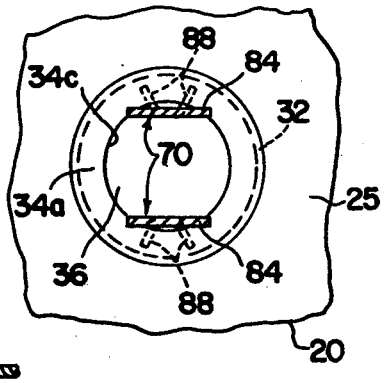
FIG. 6 is a cross-sectional view taken along line 6—6 of FIG. 2.
Figure 10:
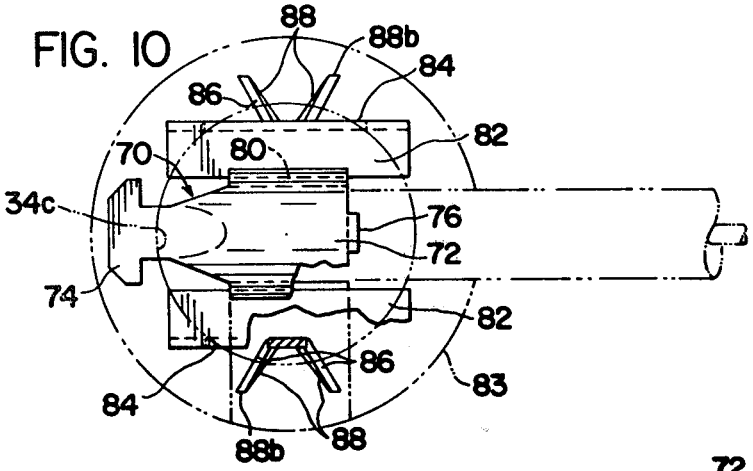
FIG. 10 is a top plan view of the clip and conductor shown in connected position within a standard anode button, the flexible cap being removed.

As best shown in FIGS. 6 and 10, where anode button B is illustrated in a plan view with annular flange 34 and concentric circular opening 36 facing outwardly therewithin and clip leg portions 70 in the installed position; a vertical projection of each of the legs may be viewed as defining a chord across circular opening 36. In order that flange rests 90 abut against flange top surface **34*a* as intended, the lateral width of legs 70 at the flange rests 90 must be greater than the length of the above-described chord in opening 36. Flange rests 90 also act to limit the depth to which the legs may be inserted into the button thereby preventing the leg ends from contacting the anode button B at its bottom surface 30**.

Flange rests 90 hold the axis of clip legs 70 perpendicular to the plane of the top surface of flange 34 and the outer surface of the cathode ray tube A by positively preventing any lateral rocking of the clip such as indicated by arrows n in FIG. 5, once the clip E is properly inserted in anode button B, which rocking could cause the clip to become disengaged or possibly cause cracking of the glass envelope of cathode ray tube A.

The clip E is shown in it final assembled configuration in all of the Figures. Before the clip is attached to conductor C and assembled with flexible cap D, the first leg portions 80 diverge and the inner diameter of the return bent portion 72 is slightly enlarged when compared to its inner diameter in the assembled configuration. In the unassembled state, the inner diameter of return bent portion 72 is slightly greater than the outer diameter of conductor C.

In the assembly of the complete contact unit in accordance with the preferred embodiment, a portion of the insulation 44 surrounding the end of a length of conductor C is removed so lead wire **42*a* is exposed and clip portion E is pressed laterally onto insulation 44 at a point spaced inwardly from the end of the insulation adjacent the bared conductor 42*a*. First leg portions 80 are pressed into parallel relationship and the inner diameter of return bent portion 72 is thereby reduced. Cylindrical return bent portion 72 thus acts to grip the insulation 44 of conductor C about an arc greater than 180°, and tang 76 pierces the insulation 44 to positively locate the clip E longitudinally and rotationally relative to conductor C and work in conjunction with the gripping of the return bent portion 72 to prevent such movements of the clip relative to the conductor. Bared conductor wire 42*a* is wrapped around extended lug 74 and soldered thereto to form a solder bead 78. The clip is now retained by three separate but coacting means, that is principally the gripping by return bent portion 72, and further the piercing of the conductor insulation 44 by tang 76 and the soldered connection of lead 42*a* to lug 74**, so that there is substantially no possibilaty of movement of the clip E relative to conductor.

The opposite end of conductor C remote from the end to which the clip E is attached is passed into cavity 52 of resilient cap D, through opening 58 and then outwardly from cavity 52 through passage 56 of barrel 54. As the conductor C is drawn through passage 56, the barrel 54 is stretched since passage 56 has a smaller diameter than that of conductor C. The tight stretch fit of barrel 54 around insulation 44 creates a strong gripping force on the conductor C. Conductor C is drawn through barrel 54 until the clip E is pulled into cavity 52 and is properly positioned therewithin with legs 70 extending outwardly through opening 58 into the concave portion of skirt 51. Cavity 52 has a shape which substantially conforms to the shape of connected conductor C and clip E so that the clip and conductor fit snugly within the cavity.

Opening 58 has a form such that it snugly abuts portions 80 of clip legs 70 and, in conjunction with a tight grip of barrel 54 about insulation 44 and the snug fit of cavity 52 about the connected portions of the clip and conductor, holds the conductor and clip unit snugly in position within the flexible cap D. Shoulder portions 82 of legs 70 abut against shield washer 83 and hold it against the underside surface 59.

With the connection of the end of conductor C remote from the clip end to high voltage source 40, the anode connector assembly is now ready to be inserted into the contact button B in order to establish electrical connection therewith and permit the operation of the CRT.

In order to make contact with the anode button B, leg ends 70 are compressed toward each other so that tab portions 88 pass through opening 36 of anode button B at which point the legs are released. The legs spring laterally outwardly so that tab corners **88*b* engage underside 34*b* of flange 34 and flange rests 90 abut or are only very slightly spaced from flange top surface 34*a***.

An alternative procedure for inserting the clip legs into the anode button would be merely to press the clip downwardly into the opening 36, the angled side portions **88*a* of tabe 88 engaging the circular edge 34*c* of the flange 34 and causing a camming action whereby the ends of the clip legs are forced together so that the widest portions, as at outward ends of tabs 88*b*, will pass into the interior of anode button B at which point the legs will spring outwardly so that the upper surface 86 of tabs 88 are in contact with underside flange surface 34*b* and flange rest 90 are in contact with or only slightly spaced from flange top surface 34*a*. Removal of the clip by a tug or a jerk on the conductor would be impossible. Further, the flange rests 90** would prevent any possible rocking of the clip relative of the anode button.

A second alternate installation technique favored by some installers involves a rocking maneuver. This technique allows the installer to get a more positive indication of a good installation. The complete anode connector is placed over the anode button on the cathode ray rube. The connector is then pressed downwardly and laterally perpendicularly to the conductor C, seating one of the legs 70 in the anode button B. Then the connector is rocked back laterally in the opposite direction, seating the other leg 70 in the anode button. In this manner the installer can feel each leg 70 engage the anode button flange 34 between the flange rests 90 and the tab corners **88*b***.

During the insertion operation, the skirt portion of cap D has been pressed resiliently downwardly and radially outwardly onto the outer surface of the CRT so that the smooth edge of skirt portion 60 is stretched outwardly and surface 62 and at least portions of ribs 55 come into pressure contact with the outer surface of glass envelope 20 of cathode ray tube A creating a seal around and concentric with anode button B as shown in FIGS. 2 and 3.

The overhead view of inserted clip E into button B such as shown in FIG. 10 illustrates the x-ray shielding effect of washer 83 in combination with Clip E when inserted into button B. Widened shoulders 82 and return bent portion 72, along with lug 74 conductor C and shiled washer 83, act to substantially cover the entire opening 36 and a substantial portion of the remainder of button B and, in conjunction with cap D, act to shield against x-ray emissions from the interior of cathode ray tube A through the opening 36, and the button B thereby eliminating the necessity of placing a shielding disc or cup in the bottom of anode button B and/or providing a thick heavy cap as has been the practice previously.

In summary, many substantial improvements over the anode connector assemblies found in the prior art have been achieved by the present invention including:

A. The substantially rigid attachment of the clip to a connector wire thereby avoiding movement which may cause disengagement of the contact;

B. The substantially rigid retention of clip and conductor within the resilient rubber cap further assuring the retention of electrical contact;

C. The reduction in the amount of expensive and heavy material used in the flexible rubber cap by the provision of reinforcing ribs and a consequent reduction of material between these ribs;

D. The prevention of rocking of the clip within the anode button by the provision of flange rests on the clip legs which abut the outer surface of the anode button, and E. The shielding of x-ray emissions by the clip, conductor and cap assembly so that the necessity of incorporating a shielding disc or cup within the anode button is eliminated.

The above improvements constitute a significant improvement in the performance characteristics of prior art anode connectors while eliminating many costly parts and costly and time consuming operations from the cathode ray tube-anode connection.

While the invention has been described in the more limited aspects of a preferred embodiment, modifications thereof have been suggested and still others will occur to those skilled in the art. Such modifications are intended to be included within the scope of the present invention which is to be limited only by the scope of the appended claims.

Having thus described the invention, I claim:

1. In an anode connector for establishing electrical contact between an anode supply conductor having an outer layer of insulation and a standard anode button disposed in the side of a cathode ray tube, said anode button having a generally cup like form comprised of a bottom, an outwardly extending side wall, and an annular flange at the outer circular edge of said side wall, said flange extending radially inwardly and defining an opening to the interior of said button, said flange being generally parallel to said bottom and generally coplanar with the outer surface of said cathode ray tube, and having an outer surface and a parallel underside surface within the interior of said button, the improvement which comprises:

a one piece sheet metal clip having a base and a pair of downwardly extending legs, said base being in the form of a generally cylindrical return bent portion of an inner diameter to encircle and tightly grip the insulation of said anode conductor about an arc greater than 180°, said return bent portion having an axis parallel to said conductor, an axially extending lug on one axial edge of said cylindrical return bent portion, a pointed tang extending perpendicular to and radially inwardly toward the axis of said return bent portion, and a pair of tabs on the lower end of each downwardly extending leg, said tabs having upper surfaces for engaging said underside surface of said flange and each downwardly extending leg having a pair of downwardly facing flat surfaces located above said tab upper surfaces a distance slightly greater than the thickness of said anode button flange whereby said clip will be locked against tipping movement relative to said anode button.

2. The improvement of claim 1 wherein said tang has a length which is generally equal to the thickness of said insulation.

3. The improvement of claim 1, further including each leg having a first portion extending downwardly from said return bent portion, a second portion extending laterally outwardly from the lower end of said first portion to form a shoulder on each of said legs spaced from said return bent portion and extending laterally from said leg axis, said second portion being transversely wider than said first portion parallel to the axis of said return bent portion, and a downwardly extending third portion at the outer edge of said second portion extending downwardly to the leg end, said tabs and said flat surfaces being in said third position.

4. The improvement of claim 1 wherein a flexible cap comprising a head portion and a dish-like skirt portion including a plurality of radially extending reinforcing ribs and web portions extending between adjacent pairs of ribs is disposed about said clip and conductor.

5. The improvement of claim 4 wherein said flexible cap is made of silicon rubber.

6. A flexible cap for shielding emissions from a clip and conductor assembly when in contact with a standard anode button of a cathode ray tube, said clip having parallel extending leg portions, said flexible cap, comprising:

a head portion including an internal cavity for containing said clip, a barrel portion extending from said head portion and having a opening therethrough for permitting the passage of said electrical conductor and an opening extending downwardly from said cavity for exiting said leg portions of said clip, and a flexible skirt portion having a dish-like shape comprised of a plurality of radially and downwardly extending reinforcing ribs extending from said head portion and a web portion thinner than said ribs extending between adjacent pairs of said ribs forming a concave inner surface and a convex outer surface.

7. The flexible cap of claim 6 wherein said opening through said barrel portion has a diameter smaller than the diameter of said conductor.

8. The flexible cap of claim 7 wherein said opening through said barrel portion tapers to a reduced diameter outwardly of said cavity.

9. The flexible cap of claim 7 wherein said skirt portion has a circular mid-line located between said head portion and the outer edge of said skirt and said ribs being defined below the concave inner surface of said web portions of the flexible skirt radially inwardly of said mid-line and above the convex outer surface of said flexible skirt radially outwardly of said mid-line.

10. The flexible cap of claim 9 wherein the inner surface of said skirt radially outwardly of said mid-line has a mirror-smooth surface.

11. The flexible cap of claim 6 wherein said cap is made of silicone rubber.

12. In an anode connector for establishing electrical contact between an insulated anode supply conductor and a standard anode button disposed in the side of a cathode ray tube, said anode button having a bottom, a side wall, and an annular flange at the outer circular edge of said side wall, said flange extending radially inwardly and defining an opening to the interior of said button, said flange being parallel to said bottom and coplanar with the outer surface of said cathode ray tube, and having an outer surface and a parallel underside surface within the interior of said button, a clip formed from sheet metal having a base and a pair of parallel downwardly extending legs having means on the end for coacting with said underside surface of said flange and holding said connector in assembled relationship with a tube;

each leg having over its length upper and lower portions extending downwardly from said base and a horizontal portion intermediate said upper and lower portions, the improvement which comprises:

said horizontal portion having a width perpendicular to its length greater than the width of said upper portion or said lower portion to form a relatively wide metallic surface parallel to and spaced from the said flange and of a substantial area compared to the area of said button which surface is opaque to x-rays.

13. In an anode connector for establishing electrical contact between an insulated anode supply conductor and a standard anode button disposed in the side of a cathode ray tube, said anode button having a generally cup like form comprised of a bottom, an outwardly extending side wall, and an annular flange at the outer circular end of said side wall, said flange extending radially inwardly and defining an opening to the interior of said button, said flange being generally parallel to said bottom and generally coplanar with the outer surface of said cathode ray tube, and having an outer surface and a parallel underside surface within the interior of said button, said flange having a predetermined thickness, said connector including a clip formed from sheet metal having a return bent portion and a pair of downwardly extending legs for fastening said connector to said button, said legs each having a leg axis extending downwardly from said return bent portion, said legs being much thinner than wide in horizontal cross-section, at least one upwardly facing surface on the lower end of each leg for engaging the underside of said flange; the improvement which comprises: the width of said legs being sharply reduced on each edge adjacent their lower ends to form on each leg a pair of downwardly facing surfaces, each surface intersecting with the outer edges of said legs in a sharp corner, said downwardly facing surfaces each extending outwardly from said leg axis at an angle such that said sharp corners form the lowest points on said downwardly facing surfaces, said sharp corners defining a horizontal plane, said upwardly facing surfaces being spaced below said horizontal plane a distance just greater than the thickness of said flange whereby when said clip is assembled with said anode button, said upwardly facing surfaces will engage the underside surface of said flange and when lateral forces are exerted on said clip, at least one of said downwardly facing surface sharp corners will engage the outer surface of said flange limiting tilting movement of said clip.

14. In an anode connector for establishing electrical contact between an anode supply conductor having an outer layer of insulation and a standard anode button disposed in the side of a cathode ray tube, said anode button having a generally cup like form comprised of a bottom, an outwardly extending side wall, and an annular flange at the outer circular edge of said side wall, said flange extending radially inwardly and defining an opening to the interior of said button, said flange being generally parallel to said bottom and generally coplanar with the outer surface of said cathode ray tube, and having an outer surface and a parallel underside surface within the interior of said button, the improvement which comprises:

a one piece clip formed from sheet metal having a base and a pair of downwardly extending legs, said base being in the form of a generally cylindrical return bent portion of an inner diameter to encircle the insulation of said anode conductor about an arc of at least 180°, said return bent portion having an axis parallel to said conductor, each leg having: a first portion extending downwardly from said return bent portion, a second portion extending laterally outwardly from the lower end of said first portion to form a shoulder on each of said legs spaced from said return bent portion and extending laterally from said leg axis, said second portion being transversely wider than said first portion parallel to the axis of said return bent portion, and a downwardly extending third portion at the outer edge of said second portion extending downwardly to the leg end, and at least one tab on each leg end, said tabs having an upper surface for engaging the underside of said flange, and, said third portion having a pair of downwardly facing surfaces located above said upper surfaces a distance just slightly greater than the thickness of said flange and at least the outermost portions of said downwardly facing surfaces engaging the outer surface of said flange whereby said clip will be locked against tipping movement relative to said anode button.

* * * * *

UNITED STATES PATENT AND TRADEMARK OFFICE

CERTIFICATE OF CORRECTION

PATENT NO. : 4,204,741

DATED : May 27, 1980

INVENTOR(S) : Harold E. Hall

It is certified that error appears in the above-identified patent and that said Letters Patent are hereby corrected as shown below:

In the drawings, Sheet 1, Fig. 1, the reference letter B should read -- D --; sheet 2, Fig. 5, the reference letter n should be applied to one of the two arrows at the bottom of the figure indicating the lateral rocking of the contact clip referred to at column 8, line 24. Column 1, lines 63-64, "assummed" should read -- assumed --. Column 4, line 28, after "embodiment" insert -- of --; line 29, "apended" should read -- appended --; line 55, delete "a"; Column 5, line 61, the reference numeral "3" should read -- 53 --. Column 6, line 30, "silicon" should read -- silicone --; line 44, "Clip" should read -- clip --; line 55, after "arc" insert -- of --; line 58, after "end" (second occurrence) insert -- 42a --; line 59, the reference numeral 42a should read -- 42 --. Column 7, line 16, "Clip" should read -- clip --; line 39, "chip" should read -- clip --; line 40, "edges" should read -- edge --; line 44, "increase" should read -- increases --; line 61, "Clip" should read -- clip --; line 63, after "surfaces" insert reference numeral -- 90 -- and after "rests" delete reference numeral "90". Column 9, line 33, "tabe" should read -- tabs --; line 40, "rest" should read -- rests --; line 44, "of" second occurrence should read -- to --.

UNITED STATES PATENT AND TRADEMARK OFFICE

CERTIFICATE OF CORRECTION

PATENT NO. : 4,204,741

DATED : May 27, 1980

INVENTOR(S) : Harold E. Hall

It is certified that error appears in the above-identified patent and that said Letters Patent are hereby corrected as shown below:

Column 10, line 3,"Clip" should read -- clip --; line 6, "shiled" should read -- shield --. Column 11, line 31, (claim 3) "position" should read -- portion --; line 38, (claim 5) "silicon" should read -- silicone --; line 42, (claim 6) after "cap" delete the comma (,); line 64, (claim 9) the claim reference numeral "7" should read -- 6 --.

Signed and Sealed this

*Fourth* Day of *November 1980*

[SEAL]

*Attest:*

SIDNEY A. DIAMOND

*Attesting Officer*

*Commissioner of Patents and Trademarks*